United States Patent [19]

Miyazawa et al.

[11] Patent Number: 4,802,776

[45] Date of Patent: Feb. 7, 1989

[54] PRINT HEAD HAVING A WEAR RESISTANT ROTATIONAL FULCRUM

[75] Inventors: Akiyasu Miyazawa, Toyota; Mineo Harada, Owariasahi; Eiji Tajima, Owariasahi; Takao Abe, Hitachi, all of Japan

[73] Assignee: Hitachi, Ltd., Tokyo, Japan

[21] Appl. No.: 91,756

[22] Filed: Sep. 1, 1987

Related U.S. Application Data

[63] Continuation of Ser. No. 803,674, Dec. 2, 1985, abandoned, which is a continuation of Ser. No. 540,158, Oct. 7, 1983, abandoned.

[30] Foreign Application Priority Data

Oct. 15, 1982 [JP] Japan ..... 57-179845

[51] Int. Cl.[4] ..... B41J 3/12

[52] U.S. Cl. ..... 400/124; 101/93.05

[58] Field of Search ..... 400/124; 101/93.05; 148/403

[56] References Cited

U.S. PATENT DOCUMENTS

| | | | |
|---|---|---|---|
| 3,994,381 | 11/1976 | Hebert | 400/124 |
| 4,084,678 | 4/1978 | Reier | 400/124 |
| 4,225,250 | 9/1980 | Wagner | 400/124 |
| 4,225,339 | 9/1980 | Inomata | 148/403 |
| 4,244,658 | 1/1981 | Mori | 400/124 |
| 4,368,353 | 1/1983 | Ando | 400/124 X |
| 4,416,709 | 11/1983 | Ohya | 148/403 |
| 4,423,969 | 1/1984 | Kobryn | 400/124 |
| 4,511,269 | 4/1985 | Takahashi | 400/124 |

*Primary Examiner*—Paul T. Sewell

*Attorney, Agent, or Firm*—Antonelli, Terry & Wands

[57] ABSTRACT

A print head having magnetic members attracted by a permanent magnet while resiliently deflecting resilient members connected to one ends thereof associated with corresponding solenoids adapted to selectively release the associated magnetic members by cancelling the magnetic attracting force of the permanent magnet, so that the magentic member is actuated by the energy stored in the resilient members to drive printing elements into a printing position. To reduce the moment of inertia of the magnetic member, the magnetic pole surface of the permanent magnet or a yoke mounted on the permanent magnet is contacted with one end of the magnetic member to form a fulcrum for the rotation of the magnetic member. The magnetic pole surface of the permanent magnet or yoke on the permanent magnet and at least the fulcrum portion of the magnetic member are provided with hardened wear-resistant layers formed, for example, by plating with nickel, thereby achieving a higher resistance to wear. The wear of the magnetic pole surface of the fulcrum and of the magnetic member are reduced thereby avoiding non-uniformity of the moment of force in the magnetic members, as well as the resilient force in the resilient members, thereby ensuring a high uniformity of the impacting force applied to all printing elements.

10 Claims, 5 Drawing Sheets

PRINT HEAD HAVING A WEAR RESISTANT ROTATIONAL FULCRUM

This is a continuation application of Ser. No. 803,674, filed Dec. 2, 1985, abandoned, which is a continuation application of Ser. No. 540,158, filed Oct. 7, 1983, abandoned.

BACKGROUND OF THE INVENTION

The present invention relates to a print head and, more particularly, to a printing mechanism of a print head in a wire matrix printer.

The most popular of various wire matrix printers, the is a so-called serial printer in which characters, numerals and so forth are printed on a paper set on a platen, by a wire matrix print head which is moved in parallel with the platen. Roughly speaking, the wire matrix print head has seven or nine wires arranged in a predetermined pattern. In addition, the wires are guided such that they are arrayed in one or two rows at the end of the print head. Solenoids corresponding to respective wires are energized selectively to project the wires through movable parts such as armatures, thereby to form dots on the paper.

The wire matrix print head of the kind described is sorted into an attracting type and a "cancellation type" in dependence upon the method of activating the movable part. U.S. Pat. No. 4,004,673 provides an example of a so-called attracting type print head wherein solenoids are electrically driven to attract the armature driving the styli. U.S. Pat. Nos. 4,004,668 and 4,225,250 provide examples of the "cancellation type" wire matrix print head, wherein resilient materials are fixed at their one ends and are attracted and flexed by associated permanent magnets. In operation, the attracting force of the permanent magnet is cancelled by the magnetic flux produced by the solenoid, so that the strain energy stored in the resilient member is released to act on the wire styli thereby to print dots on the paper.

The cancellation type matrix print head is superior to the attracting type, in that the heat generation in the waiting condition is small and that a large attracting force can be obtained even by permanent magnets of a smaller size. The matrix print head of the cancellation type, therefore, is better suited for practical use.

In the print head of the cancellation type, the strain energy is stored by the deflection of the resilient member, and the printing wires are made to fly as the stored energy is released. Namely, the resiliency of the resilient member is directly used as the printing energy acting on the printing wire. This means that the quality of the print is largely affected by the factors such as the resilient force exerted by the resilient members, extent of non-uniformity of the resiliencies and so forth.

Various efforts have been made to attain higher printing speed by, for example, reducing rotational moment of the magnetic members as much as possible. More specifically, it is suggested to minimize the weights of the magnetic members, levers connected to the magnetic members, wires and so on, and to minimize the distance between the point of action of the wire and the fulcrum around which the wire is rotated.

In, for example, commonly assigned U.S. patent application Ser. No. 480,788, a print head is proposed which attempts to minimize the distance between the point of action and the fulcrum, thereby attaining a high printing speed. More specifically, this improved print head has a plurality of magnetic members with one end of the magnetic member having wires are fixed directly or indirectly thereto, and permanent magnets carrying yokes for attracting the magnetic members, wherein the magnetic members are held in contact at their rear ends with the magnetic pole surfaces of the permanent magnets or the yokes, thus providing the fulcrums. According to this arrangement, it is possible to remarkably reduce the distance between the point of action of the wire and the fulcrum of the same and, hence, to achieve a high printing speed, as compared with known print heads.

Accordingly, an object of the invention is to provide an improved print head which attains higher wear resistance of at least the magnetic pole surface which serves as an attracting surface for attracting the magnetic member acting on the printing element and which cooperates with the magnetic member in defining therebetween a magnetic path.

It has been determined that, if the contact portion for contact with the magnetic member and serving as the fulcrum of rotation of the same, is formed on the magnetic pole surface of the permanent magnet or the yoke mounted on the permanent magnet in the cancellation type print head mentioned before, the member presenting the magnetic pole surface is worn rapidly.

According to the invention, at least the magnetic pole surface of the yoke or the permanent magnet presenting the magnetic pole surface is hardened by a treatment with magnetically permeable material. The hardening treatment is conducted, for example, by plating with a material consisting essentially of nickel. As another measure for hardening, a magnetically permeable sheet, subjected to a hardening treatment is formed on the magnetic pole surface, whereby taking a hard layer is formed on the magnetic pole surface to improve the wear resistance of the latter.

The hardening of the magnetic pole surface, however, may cause a rapid wear of the contact portion of the magnetic member, because the hardness of the contact portion is less than that of the magnetic pole surface. The invention, therefore, does not exclude the hardening treatment on at least the contact portion of the magnetic member.

Thus, another object of the invention is to provide a print head improved to attain a higher wear resistance of the magnetic member which actuates the printing element.

After the impacting of the printing element, the electric power supply to the solenoid is interrupted so that the magnetic member is reset by the attracting force of the permanent magnet and is stopped or collides with the core of the solenoid. This means that rapid wear tends to be caused also in the magnetic pole surface of the core.

Accordingly, another object of the invention is to provide a print head in which the magnetic pole surface of the core and at least the portion of the magnetic member facing the core are hardened by a treatment similar to that explained before to exhibit greater resistance to wear.

In the print head of the type described, the amount of resilient deformation of the leaf spring is determined by the position and posture of the rotatable magnetic number serving as the armature. The position and posture of the magnetic member, however, are changed undesirably due to wear of the magnetic member itself and the wear of the magnetic pole surface constituting the fulcrum of rotation of the magnetic member. In addition, different springs exhibit different amounts of resilient deformation. For these reasons, it is difficult to store constant strain energy in each spring and to uniformalize the energy in all springs. Consequently, there is a failure in a uniformity of operation of the armatures thereby impairing the quality of the printing.

According to the invention, since the suitable portions of the magnetic members, yokes and cores which may tend to show rapid wear are treated to exhibit higher resistance to wear, the lack of uniformity of the armature operation due to wear of such portions can be avoided to ensure a higher quality of the printing.

These and other objects, features and advantages of the invention will become clear from the following description of the preferred embodiment taken in conjunction with the accompanying drawings.

DETAILED DESCRIPTION

A preferred embodiment of the invention is applied to a wire dot matrix printer having twenty-four wire styli as the printing elements. Although seven or nine wire styli are enough for printing alphabet and numerals, printing of the Japanese peculiar characters called Kanjis requires greater number of dots, e.g. sixteen or twenty-four wire styli.

Figure 1:
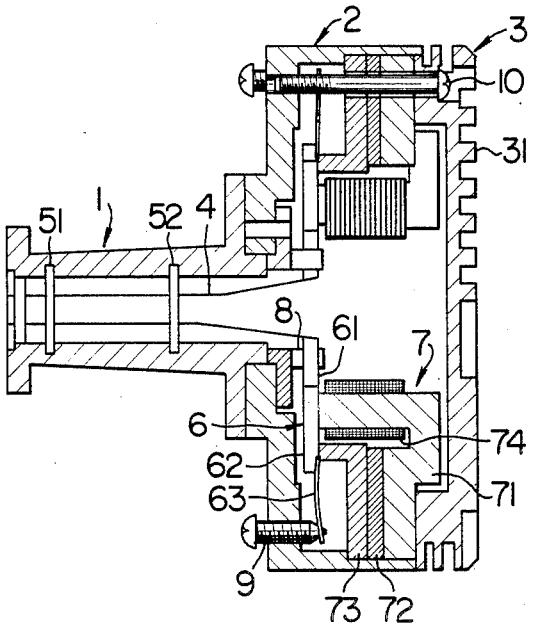
FIG. 1 is a sectional side elevational view of a wire styli dot matrix printer embodying the present invention.
Figure 2:
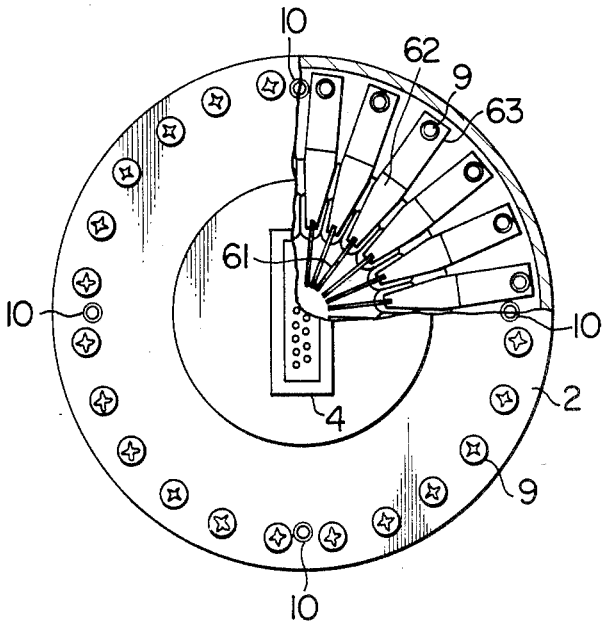
FIG. 2 is a partly cut-away front elevational view of the print head shown in FIG. 1 as viewed from the left side in FIG. 1.

Referring now to the drawings wherein like reference numerals are used throughout the various views to designate like parts and, more particularly, to FIGS. 1 and 2, according to these Figures, the print head has an outer frame composed of a nose frame generally designated by the reference numeral 1, housing frame generally designated by the reference numeral 2 and an outer plate generally designated by the reference numeral 3. The nose frame 1 guides twenty-four wire styli in a predetermined manner, and is provided with guides 51 and 52 having through bores for guiding respective wire styli 4. The wire styli 4 are guided in such a manner as to form two rows at the end of the print head. The outer plate 3 is made from a metallic material such as aluminum, and is provided with a heat sink 31 for externally radiating the heat produced in the print head. The following printing mechanism is mounted in the space defined by the housing frame 2 and the outer plate 3.

Figure 3:
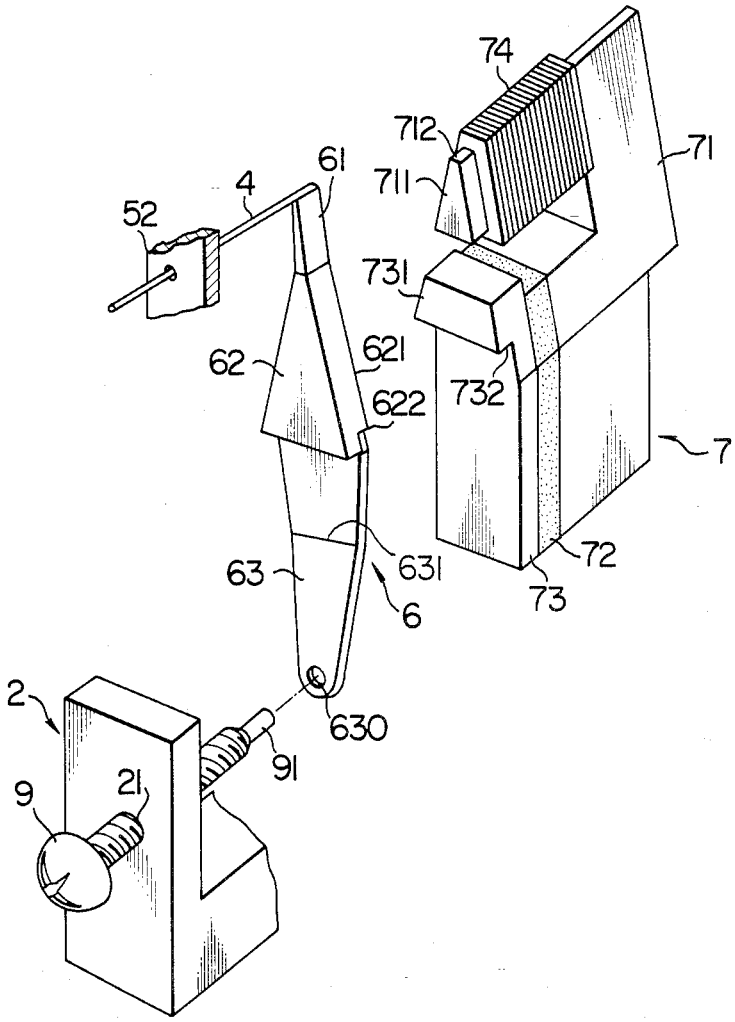
FIG. 3 is an exploded perspective view of the printing mechanism of the print head as shown in FIG. 1.

As shown in FIG. 3, the printing mechanism has a plurality of combinations of a lever unit generally designated by the reference numeral 6 and an actuating mechanism generally designated by the reference numeral 7 for the lever unit, with the number of combinations of lever units and actuating mechanisms 7 corresponding to the number of the wire styli 4. When the print head is provided with, for example, twenty-four wire styli 4, twenty-four combinations of lever unit 6 and actuating mechanism 7 are arranged within a housing frame 2 such that the wire styli 4 are directed radially inwardly towards the center of the print head.

As shown in FIG. 3, the lever unit 6 is composed of a lever member 61, a magnetic member 62 and a spring member 63 in the form of a leaf spring. A wire stylus 4 is fixed to the end of the lever member 61 by, for example, brazing, with the lever member 61, in turn, being fixed to one end of the magnetic member 62 by, for example, brazing. The spring member 63, having a predetermined resiliency, is fixed to the other end of the magnetic member 62 by, for example, brazing.

The spring member 63 may be made of a resilient metallic member such as stainless steel. However, considering the strength from the view point of dynamics and any unfavorable effect of heat caused during brazing, elgiloy is the most preferred material among the materials available at the present stage. Generally, the magnetic member 62 can be made from a magnetic material such as iron. However, considering the magnetic saturation characteristics silicon steel is most suitable.

In a modified form, the magnetic member 62 is extended to the position of the lever unit 61 and the wire stylus 4 is fixed to the thus extended end of the magnetic member. With such an arrangement, it is possible to eliminate the work for connecting the lever unit 61 to the magnetic member 62 and to save the brazing material. On the other hand, however, there is a strong demand for increasing the printing speed. To cope with this demand, it is advisable to reduce the weight of the lever unit 6 as much as possible. From this point of view, it is preferable to connect the lever unit 61, stainless steel, to the end of the magnetic member 62. The twenty-four lever units 6, thus constructed, are arranged with the associated wire styli 4 disposed radially inwardly towards the center. Thus, each combination of the lever unit 61 and the magnetic member 62 has an isosceles triangular form or a sector form. The juncture between the spring member 63 and the magnetic member 62 are constructed to present a plane which is substantially parallel with the magnetic attracting surface 621. As described hereinbelow, a corner 622 of the magnetic member 62 contacts the magnetic surface 731 of a yoke 73, so as to form a fulcrum for rotation.

A hole 630, for adjusting the spring force of the spring 63, is formed in the rear end of the spring 63. The spring 63 is slightly bent at its mid portion to form a bent portion 631. Therefore, the rear end of the spring 63 is slightly bent towards the end of the printing head, i.e. towards a screw 9 for reasons described below.

The actuating mechanism 7 has a first yoke 71 having a specific configuration having a core 712 formed integrally therewith, a permanent magnet 72 fixed onto the first yoke 71, and a second yoke 73 fixed to the other side of the permanent magnet 72. A coil 74 is wound around the core 712 so that the coil 74 and the core portion 712 in combination constitute a solenoid. The end surface of the core 712 forms a magnetic pole surface 711.

A projection 732 is formed on the side surface of the second yoke 73 facing the lever unit 6. The first yoke 71, the permanent magnet 72 and the second yoke 73 are unitarily constructed to form an assembly of twenty-four assemblies arranged in a radial form, with the assemblies being clamped between the outer plate 3 and the housing frame 2, and fixed by bolts 10.

The housing frame 2 is provided, in the bottom wall thereof, with a plurality of apertures 21 formed along a circle at a constant pitch, with the number of the apertures 21 corresponding to the number of the wire styli 4. Thus, there are twenty-four apertures 21, with the apertures 21 receiving respective screws 9 for pushing the rear ends of the springs 63. Thus, the initial load or resilient force of the springs 63 is adjusted by rotating the screws 9. More specifically, projections 91 are provided on the ends of the screws 9 and, as shown most clearly in FIG. 3, each spring 63 is supported for a limited rotation while being pushed by the screw 9. The projection 91 functions to prevent the spring 63 from being displaced in longitudinal direction thereof. The lever unit 6 has freedom also in the plane thereof. Therefore, to prevent the oscillation of the lever unit 6 particularly during the rotation of the same, a comb-like guide member 8 is provided on the center of the housing frame 2.

A plurality of combinations of the lever unit 6 and actuating mechanism 7 are disposed in the housing frame 2, with the lever unit 6 and the actuating mechanism 7 of each combination being disposed such that the magnetic pole surface 621 of the magnetic member 62 is opposed to the magnetic pole surface 711 of the core 712 and the magnetic pole surface 731 of the second yoke 73. In addition, the corner 622 of the magnetic member 62 is in contact with the magnetic pole surface 731 so that the fulcrum of rotation of the lever unit 6 is formed on the magnetic pole surface 731. Since the fulcrum is formed on the magnetic pole surface 731, the distance between the fulcrum and the end of the lever unit 6 is minimized to permit a high-speed operation of the lever unit 6.

According to this arrangement, in the normal state of operation, the magnetic member 62 is attracted to the magnetic pole surface 731 of the yoke 73 and also to the magnetic pole surface 711 of the core 712, by the magnetic flux produced by the permanent magnet 72. As a result, the spring 63 is resiliently deflected to store the energy. The amount of deflection is adjustable by the depth of insertion of the screw 9. Preferably, the adjustment by the screw 9 is made such that, the point at which the spring 63 is pressed by the screw 9, is located on the same plane including the magnetic surfaces 711 and 731.

As the electric current is supplied to the coil 74 in the described manner, magnetism is generated around the core 712 to cancel the magnetic flux of the permanent magnet 72. Consequently, the magnetic member 62 rotates around the fulcrum constituted by the corner 622 thereof, by the force of the spring 63. As a result, the wire stylus 4 is moved along the guide 52 or 51 to project its end from the end of the print head to impact the printing paper, thereby printing a dot which is a constituent of the character.

Figure 6:
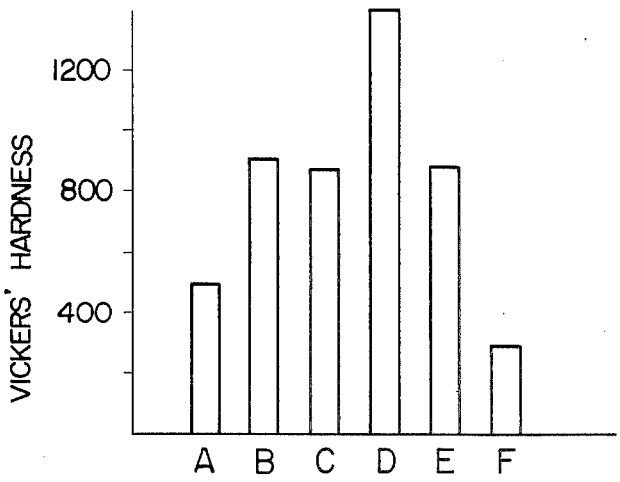
FIG. 6 is a graph showing the levels of hardness provided by different plating materials.
Figure 7:
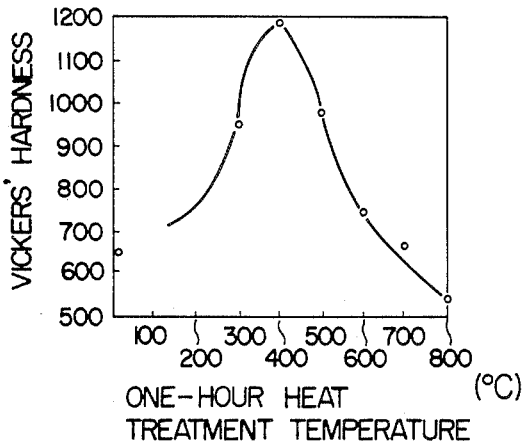
FIG. 7 is a graph showing the relationship between the heating temperature and hardness.

At least the magnetic attracting surface 621 and the corner 622 of the magnetic member 62 are chemically plated with nickel by a thickness of about 20 μm as A in FIG. 6. This treatment is called kanigen plating (Ni-P). Subsequently, a hardening heat treatment is conducted at 300° to 500° C. as shown in FIG. 6 as B to provide a hardness higher than Hv 900 as shown in FIG. 7. As a result, magnetic permeability is imparted to the nickel which is inherently non-magnetic. On the other hand, the magnetic pole surface 711 of the core 712 and the magnetic pole surface 731 of the yoke 73 are coated by a layer of about 20 μm thick, which is formed by a chemical nickel plating with the addition of fine particles of silicon carbide (SiC) having Vickers' hardness of Hv 3000 or higher, i.e. so-called non-electrolytic composite nickel plating (Ni-P-SiC) as C in FIG. 6. After the plating, a hardening heat treatment is conducted at a temperature of 300° to 500° C. as shown in FIG. 7 to attain a hardness higher than Hv 1100, as D in FIG. 6. As a result of this heat treatment, the nickel which is inherently non-magnetic becomes to exhibit magnetic permeability. The plating materials on both of the magnetic member 62 and the associated member, i.e. the core 712 and the yoke 73, are nickel-base materials. Since such materials become ferromagnetic as a result of the heat-treatment, the plating layers do not adversely affect the magnetic gap from the view point of the magnetic attracting force, even though the plating is effected on the magnetic attracting surfaces of the magnetic member 62, the core 712 and the yoke 73. Namely, the attracting force of the permanent magnet 72 effectively acts on the magnetic member 62, regardless of any slight fluctuation of the plating thickness.

If the plating materal is a non-magnetic material it is difficult to achieve a plating thickness control during the plating, e.g. zinc, chromium and so forth, the plating thickness has an effect on the magnetic gap in the magnetic path. Namely, in such a case, any fluctuation of the plating thickness causes a large difference of the attracting force exerted on different magnetic members, which, in turn, produces a large difference in the amount of adjustment of the deflection of the springs 63, seriously impairing the high-speed printing performance of the printer. However, the magnetic pole surfaces 711, 731 of the core and the yoke after the plating may be subjected to a polishing to make the thickness of the plating layer more uniform. The plating of the magnetic pole surfaces 711, 737, therefore, may be made with hard chrome plating as E in FIG. 6, and such a modification is still within the scope of the invention. Conventional electrolytic nickel plating is shown as F in FIG. 6 for the purpose of comparing such plating the above described various plating processes.

In the print head in which the magnetic member is accelerated by the strain energy stored in the spring 63 to impact a wire stylus, the strain energy stored in the spring 63 is quite an important factor for assuring a high quality of the printing, i.e. stable printing energy or stable operation within a predetermined time. The most significant feature of the invention resides in the point mentioned above, as will be understood from the following description.

Figure 4:
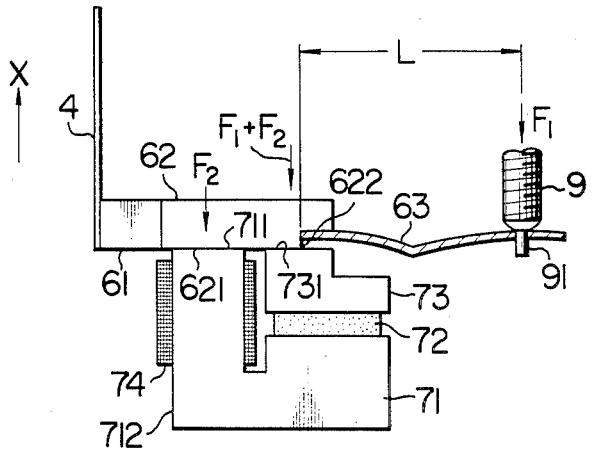
FIG. 4 is a side elevational view showing a lever and a mechanism for actuating the lever.

In FIG. 4, the lever unit and the actuating mechanism for the lever unit is illustrated in the initial state in which the magnetic member 62 is attracted by the core 72 and the yoke 73. As the coil 74 is energized, the magnetic member 62 starts to rotate in the direction x around the corner 622. In this state, the sum of the pressing force $F_1$ exerted by the spring 63 and the attracting force $F_2$ produced by the core 712 is applied between the corner 622 and the magnetic pole surface 731 of the yoke 73, neglecting the force of inertia. As the operation is repeated under the application of this force, the hardening or wear-resisting treatment of the corner 622 of the magnetic member, as well as the magnetic pole surface 731 of the yoke 73, is a matter of great significance in obtaining sufficiently long service life, i.e. resistance to wear, of the print head.

Figure 5A:
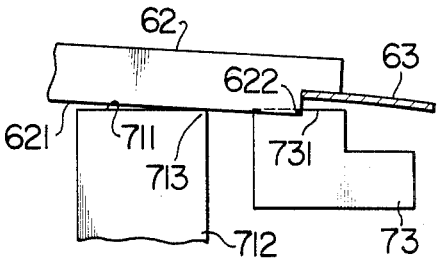
FIGS. 5*a* and 5*b* are fragmentary side elevational views showing a magnetic member, yoke and a core depicting the states of wear of components treated under different treating conditions.

In FIG. 5*a*, the hardness of the wear-resisting plating on the magnetic pole surface 731 of the yoke 73 is lower than the hardness of the wear-resisting plating on the corner 622 of the magnetic member 62. In this case, the magnetic pole surface 731 of the yoke 73 exhibits greater wear than the corner 62 of the magnetic member 62. Consequently, the magnetic pole surface 731 of the yoke 73 is worn and recessed from the initial state shown by broken line to the state shown by full line, so that the corner 622 of the magnetic member 62 comes into the recess in the yoke 72. As a result, the magnetic attracting surface 621 of the magnetic member 62 is contacted by the corner 713 of the core 712, so that the magnetic member 62 attracted by the core 72 is initially inclined as will be seen from FIG. 5*a*. Consequently, the posture of the spring member 63 is also changed to decrease the pressing force $F_1$. The reduction in the pressing force exerted by the spring directly affects the printing power to reduce the same and, disables the wire stylus 4 to complete the operation in a preselected period thereby undesireably imparing the high-speed printing. Furthermore, since the magnetic member 62 is inclined in the attracted state, the end of the wire stylus 4 at the end of the print head is deviated from the original or initial position, i.e. the position taken before the wear, to project out of the bearing. As a result, the wire stylus 4 tends to catch the ribbon when the print head moves, often resulting in a serious accident such as breakdown of the stylus end by the pulling force exerted by the ribbon.

Figure 5B:
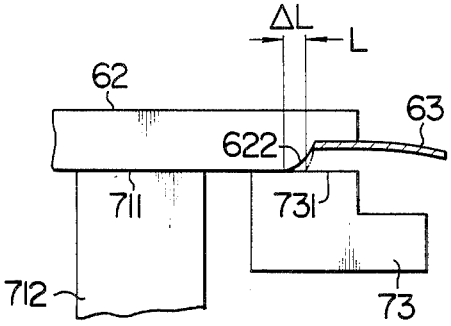

In FIG. 5*b*, the hardness of the plating on the corner 622 of the magnetic member 62 is somewhat lower than that of the plating layer on the magnetic pole surface 731 of the yoke 73, to the contrary to the case of the arrangement shown in FIG. 5*a*. In the preferred form of the invention shown in FIG. 5*b*, both of the plating layers, i.e. the plating layer on the corner 622 and the plating layer on the magnetic pole surface 731, are formed from a wear-resistant and magnetically permeable material which does not substantially affect the magnetic attracting force.

In the preferred form of the invention shown in FIG. 5*b*, the wear appears most heavily at the corner 622 of the magnetic member 62. Namely, in this case, the wear appears only to gradually round the corner 622 of the attracting member 62 as illustrated by the full line in FIG. 5*b* from the initial state shown by the broken lines. On the other hand, the magnetic pole surface 731 of the yoke 73 is worn only slightly because it is coated by the composite nickel plating layer having a higher hardness, i.e. a higher wear resistance, than the plating layer on the corner 622 and containing SiC or the like additive. In the illustrated preferred form of the invention, therefore, the wear grows only at the corner 622 of the mangetic member 62 so that the posture of the magnetic member 62 is never changed during long use, thereby preventing any secular change in the pressing force exerted by the spring 63, unlike the former arrangement explained before in connection with FIG. 5*a*.

In the preferred form of the invention, the position of the fulcrum of rotation of the magnetic member 62 on the magnetic pole surface 731 of the yoke 73 is changed by $\Delta L$ as shown in FIG. 5*b*. Therefore, even if the pressing force $F_1$ exerted by the spring 63 at the pressing point is decreased, due to slight wear at the pressing point, the rotational moment applied to the magnetic member 62 is never changed because the arm length of the moment, i.e. the distance between the fulcrum and the point at which the spring is pressed by the screw 9 is increased by the above-mentioned distance $\Delta L$, so that the rotational moment is maintained substantially constant. Namely, since the strain energy obtained through the initial adjustment is maintained unchanged over a long period of use, no substantial change is caused in the printing force and the period of the repititional printing cycle, thereby ensuring a stable high-speed operation for a long period of time.

Although the invention has been described through its preferred form, the described embodiment is not exclusive and various changes and modifications may be imparted thereto. For instance, it will be clear to those skilled in the art that the particles of silicon carbide (SiC) added to the plating material can be substituted by other particles such as of titanium carbide (TiC) having a hardness of Hv 3200 or tungsten carbide (WC) having a hardness of Hv 2400. Although in the described embodiment the plating is conducted by non-electrolytic composite nickel plating method in which the fine particles of silicon carbide or the like is added to the plating material, the invention does not exclude the use of such a method that the plating is first made by known chemical plating method with nickel, followed by a diffusion of the fine particles by a suitable mechanical means into the plating surface layer, thereby a higher hardness than that exhibited by the chemical nickel plating layer solely.

According to the invention, the treatment for attaining higher resistance to wear is conducted by plating with a nickel-base material, because the nickel-base plating layer does not cause any substantial change in the magnetic gap from the view point of the magnetic attracting force. In addition, the use of the nickel-base material offers the following advantage. Namely, when the wear-resisting layer is formed from nickel-base material, the dust of this material caused by the wear is changed into nickel oxide NiO due to contact with oxygen in the air at a high temperature generated as a result of the friction. The nickel oxide thus formed takes the form of fine powder, having a hardness which is as low as Hv 450. The soft fine powder of nickel oxide then comes into the gap between the magnetic attracting member 62 and the associated parts, i.e. the yoke 73 and the core 72, so as to serve as a lubricant to decrease the friction therebetween, thereby effectively suppressing the further wear of the part.

In contrast to preferred embodiment described hereinabove in which hard wear resisting layers are formed by plating on the magnetic pole surfaces 731 and 711 of the core 73 and the yoke 712, the print head of the modifications shown in FIGS. 8*a* to 9*b* employ a magnetically permeable wear-resistant sheet 11 having a hard layer placed on the magnetic pole surfaces 731 and 711, instead of the plating. It will be clear to those skilled in the art that these modifications provide the same effect as that produced by the above described embodiment, and that a further improvement can be achieved when the core 73 and the yoke 712 having wear-resistant sheets 11 thereon are used in combination with the magnetic member 62 which has been subjected to a hardening treatment as in the described above. Namely, in such a case, the corner 622 of the magnetic member 62 is made to contact with the sheet 11 to constitute the fulcrum for the rotation thereof.

The wear-resistant sheet 11 is composed of, for example, a substrate 112 made of a magnetically permeable material such as silicon steel and a wear-resistant hardened layer 111 formed on the substrate 112 by a hardening treatment such as, for example, precipitation hardening treatment by nickel plating. The wear-resistant sheet 11 is placed on the surface of the magnetic pole surface 711 of the core 72 and the magnetic pole surface 731 of the yoke 73 such that the wear-resistant hardened layer 111 faces the magnetic member 62.

Figure 8A:
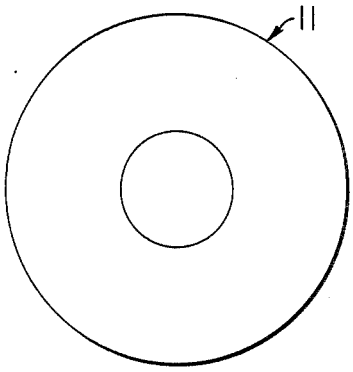
FIG. 8*a* is a plan view of an example of a wear-resistant sheet used in another embodiment.
Figure 8B:
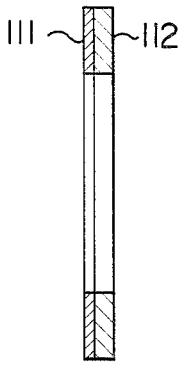
FIG. 8*b* is a sectional view of the wear-resistant sheet as shown in FIG. 8*a;*
Figure 9A:
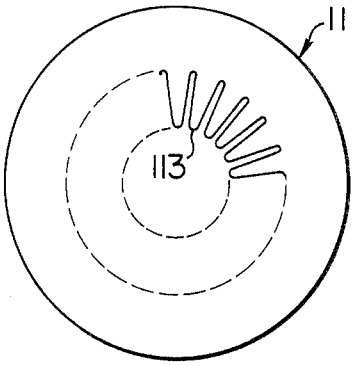
FIG. 9*a* is a plan view of another example of the wear-resistant sheet.
Figure 9B:
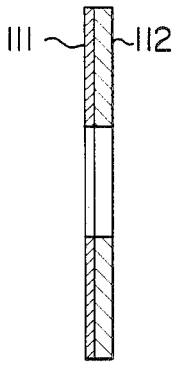
FIG. 9*b* is a sectional view of the wear-resistant sheet shown in FIG. 9*a*.

In FIGS. 8*a* and 8*b* an integral disc-shaped wear-resistant sheet 11 is adapted to cover the magnetic pole surfaces 731 and 711, while in FIGS. 9*a* and 9*b* illustrates a wear resistant sheet 11 in which the portions corresponding to the magnetic pole surfaces 711 are made in the form of segments 113.

According to the invention, by extremely reducing the thickness of the wear-resistant sheet 11, it is possible to remarkably decrease the leak of magnetic fluxes to adjacent magnetic poles through the sheet 11. In such a case, there is no need for taking a labor to slit the portion of the wear-resistant sheet 11 corresponding to the magnetic pole surfaces 711 as shown in FIG. 7. When the wear-resistant sheet 11 has a considerable thickness, however, the amount of the leaked magnetic flux is increased to a level which undesirably decreases the efficiency. In such a case, therefore, it is preferred to adopt the wear-resistant sheet 11 shown in FIGS. 9*a* and 9*b* in which the portion corresponding to the magnetic pole surface 711 is slotted into the form of segments.

The material of the wear-resistant sheet 11 is not limited to the silicon carbide, and the wear-resistant sheet 11 may be formed from other magnetic material having a high magnetic permeability. Similarly, the hardening treatment can be made not only by the precipitation hardening treatment through chemical nickel plating but also by various other methods such as carburizing, plating with hard chromium and so forth. It is also possible to use a material, as the material of the wear-resistant sheet, which does not have two distinctive portions, i.e. the substrate and the hardened wear-resistant layer, provided that the material exhibits both of high magnetic permeability and high resistance to wear. A typical example of such a material having both of the magnetic permeability and the hardness is amorphous metals since amorphous metals having amorphous structure usually exhibits both of high hardness and good magnetic properties and, hence, can form extremely thin sheets which exhibit both high magnetic permeability and hardness without requiring any hardening treatment such as plating.

The use of such wear-resistant sheets is quite advantageous because, when the sheet is worn down, the sheet can be replaced with new one without substantial difficulty thereby permitting an easy recovery of the required resistance to wear.

What is claimed is:

1. A print head comprising:

a plurality of printing elements;

a plurality of armatures corresponding to said printing elements for activating said printing elements fixed to one respective end of each of said armatures;

a plurality of resilient members, each being fixed to another respective end of each of said armatures;

a first magnet having magnetic poles, one of said magnetic poles being situated between said one end of armatures and another of said magnetic poles for attracting said armatures such that a closed path for magnetic flux can be established through each of said armatures and said first magnet in contact with each other at said magnetic poles of said first magnet, while resiliently deflecting said resilient members; and a plurality of second magnets for cancelling the attracting force from said one magnetic pole of said first magnet to actuate said aramatures by the resilient force of said resiliently deflected resilient members;

wherein hardness of a surface of said another magnetic pole is higher than the hardness of an edge at said another end of each of said armatures, each of said another magnetic pole surfaces being in contact with said edge at said another end of each of said armatures so as to form a fulcrum for rotation of said each armature therearound.

2. A print head according to claim 1, wherein said surface of said another magnetic pole of said first magnet has thereon a wear-resistant layer made from nickel based material subjected to a hardening treatment.

3. A print head according to claim 1, further comprising a plurality of adjusting members engaging an end of a corresponding resilient member opposite to an end thereof fixed to said one end of said respective armature so as to adjust the resilient force of said resilient members by adjusting a position of the engaged end thereof relative to the fulcrum point thereof.

4. A print head according to claim 1, wherein said surface of said another magnetic pole of said first magnet has a wear-resistant layer made from nickel-based material subjected to hardening treatment, a surface of said edge at said another end of each of said armatures has another wear-resistant layer made from nickel-based material subjected to hardening treatment, the hardness of said one wear-resistant layer being higher than the hardness of the other wear-resistant layer.

5. A print head according to claim 4, wherein said one wear-resistant layer includes tungsten carbide, whereby the hardness of said one wear-resistant layer is higher than that of the other wear-resistant layer.

6. A print head comprising:

a plurality of printing elements;

a plurality of armatures corresponding to said printing elements for activating said printing elements fixed to one respective end of each of said armatures;

a plurality of resilient members, each being fixed to another respective end of each of said armatures;

a first magnet having magnetic poles, one of said magnetic poles being situated between said one end of armatures and another of said magnetic poles for attracting said armatures such that a closed path for magnetic flux can be established through each of said armatures and said first magnet in contact with each other at said one and another magnetic pole of said first magnet while resiliently deflecting said resilient members;

a plurality of second magnets for cancelling the attracting force from said one magnetic pole of said first magnet to actuate said armatures by the resilient force of said resiliently deflected resilient members; and a wear-resistant layer made from nickel-based material subjected to a hardening treatment being formed on said surface of said another magnetic pole of said first magnet so as to provide for a magnetically permeable seat means, wherein hardness of the wear-resistant layer is higher than the hardness of an edge at said end of each of said armatures, each said another magnetic pole surface being in contact with said edge at said another end of each of said armatures so as to form a fulcrum for rotation of said each armature therearound.

7. A print head according to claim 6, wherein said first magnet comprises a permanent magnet.

8. A print head according to claim 6, further comprising a wear-resistant layer formed on said surface of said one magnetic pole of said first magnet and formed with a hardening material containing a magnetically permeable material.

9. A print head according to claim 6, wherein at least a portion of said armature in contact with said wear-resistant layer of said first magnet has been subjected to a hardening treatment to exhibit a hardness which is not higher than the hardness of said wear-resistant layer of said first magnet.

10. A print head according to claim 7, wherein said permanent magnet has poles corresponding to said one and another poles of said first magnet, said first magnet further comprising:

a first yoke, one end of which contacts said another pole of said permanent magnet and a surface of another end of which constitute said surface of said another pole of said first magnet; and a second yoke having a generally U-shaped cross-section, wherein a surface of one end of one leg portion serving as a core for said second magnet and end surface of said one leg of said second yoke constituting said surface of said one magnetic pole of said first magnet, while another end of another leg portion of second yoke contacting said one pole of said permanent magnet.

* * * * *